US005931031A

United States Patent [19]

Bouan

[11] Patent Number: 5,931,031

[45] Date of Patent: Aug. 3, 1999

[54] LOCKING SYSTEM, PARTICULARLY FOR THEFT PREVENTING BOXES FOR PROTECTING PACKAGES, AUDIO AND VIDEO TAPES, ELECTRONIC GAMES AND COMPACT DISCS

[75] Inventor: Bruno Bouan, La Varenne, France

[73] Assignee: Fors Brance S.A., Saint Maur Des Fosses, France

[21] Appl. No.: 08/981,721

[22] PCT Filed: Jun. 20, 1996

[86] PCT No.: PCT/FR96/00961

§ 371 Date: Apr. 20, 1998

§ 102(e) Date: Apr. 20, 1998

[87] PCT Pub. No.: WO97/01013

PCT Pub. Date: Jan. 9, 1997

[30] Foreign Application Priority Data

Jun. 22, 1995 [FR] France ..... 95 07510

[51] Int. Cl.[6] ..... E05B 65/00

[52] U.S. Cl. ..... 70/57.1; 206/1.5; 70/276

[58] Field of Search ..... 70/57.1, 58, 63, 70/276; 292/87; 206/1.5, 308.2, 387.11

[56] References Cited

U.S. PATENT DOCUMENTS

| | | | |
|---|---|---|---|
| 4,964,661 | 10/1990 | Cadwell et al. | 292/87 |
| 5,079,540 | 1/1992 | Narlow et al. | 70/57.1 X |
| 5,209,086 | 5/1993 | Bruhwiler | 70/57.1 |
| 5,215,189 | 6/1993 | Weisburn et al. | 206/1.5 |
| 5,289,914 | 3/1994 | Holmgren | 206/1.5 |
| 5,368,162 | 11/1994 | Holmgren | 206/387 |
| 5,390,515 | 2/1995 | Essick | 70/57.1 X |
| 5,588,315 | 12/1996 | Holmgren | 70/57.1 |
| 5,598,728 | 2/1997 | Lax | 70/57.1 X |
| 5,782,350 | 7/1998 | Weisburn et al. | 206/308.2 |
| 5,802,890 | 9/1998 | Espada-Velasco | 70/57.1 |

*Primary Examiner*—Suzanne Dino Barrett

*Attorney, Agent, or Firm*—Irving N. Feit; Hoffmann & Baron, LLP

[57] ABSTRACT

A locking system comprising a fixed portion secured to a box with a slot for inserting an article to be protected, and a movable portion with a latching member for partially sealing the insertion slot in the locked position. The system further comprises means for preventing the movable portion from being moved unless a specific tool is used. The fixed portion has a rear guide extending in a substantially longitudinal direction, and a front projection with an opening having a substantially longitudinal rear section and an angled section extending therefrom up to the upper edge of said front projection. The movable portion comprises a hollow member with a transverse wall adjacent to the rear end surface thereof provided with a slot having a cross-section matching that of the guide on the fixed portion at least one transverse projecting pin being arranged on the intermediate portion of said hollow member for engaging the opening in the fixed portion in order to guide the movable portion as it is moved longitudinally at first and then obliquely.

9 Claims, 1 Drawing Sheet

LOCKING SYSTEM, PARTICULARLY FOR THEFT PREVENTING BOXES FOR PROTECTING PACKAGES, AUDIO AND VIDEO TAPES, ELECTRONIC GAMES AND COMPACT DISCS

BACKGROUND OF THE INVENTION

The present invention relates to a locking system that is intended to prevent the theft of articles from shelves or to prevent withdrawing an article from a housing that contains it, for articles such as cassettes, video cassettes, compact disks, CD-ROMs, eyeglasses, bottles, sets of bottles, etc.

SUMMARY OF THE INVENTION

In the state of the art, several solutions are known, particularly a locking system described in French Patent No. 2,678,907. The device described in this patent is generally satisfactory. The purpose of the invention is to further simplify the embodiment by reducing the number of parts, and by giving the parts a profile that makes it possible to reduce the cost of the molding and the assembly. Another purpose is to further increase the effectiveness of the system against tampering attempts, by improving the mechanical resistance.

To this effect, the invention more particularly concerns a locking system of the type comprising a fixed part that is integrally connected to a housing having a slot for the introduction of the article to be protected, as well as a movable part having an abutment that can partially close the introduction slot in the locked position. In addition, the system comprises a means that can prevent the displacement of the movable part without the use of a specific tool. The fixed part has a guide at its back that extends along a substantially longitudinal direction. In front of this guide, a protuberance has a hole that comprises a substantially longitudinal back segment, which is extended by an inclined segment extending to the top edge. The movable part comprises a hollow part having, in proximity to its back end, a transverse partition perforated by a slot. This slot has a section that is complementary to the section of the guide provided on the fixed part. In its midsection, the movable part comprises a transverse projecting rod that can work in cooperation with the hole of the fixed part so as to ensure the guiding of the movable part in, first, a longitudinal movement, then an oblique movement.

Advantageously, the locking system according to the invention comprises a blade running along the top face of the movable part in a substantially longitudinal direction—of which one end is integrally connected to the back part of the movable part, and the front part is free—and which extends, at rest in the locked position, against an abutment provided on the protuberance of the fixed part.

According to a preferred embodiment, the free end of said blade has a cutting edge. This characteristic is intended to prevent accidental unlocking when a violent shock causes the blade to vibrate.

According to an advantageous variant, the system comprises a spring that bears against the fixed part and against the movable part, so as to facilitate the displacement of the movable device after unlocking.

According to an advantageous embodiment example, the spring is housed in an inclined hole provided in front of the protuberance of the fixed part.

According to another embodiment variant, the protuberance of the fixed part has an extension that projects out of the front face and that works in cooperation, in the locked position, with a housing provided for this purpose in the front face of the movable part.

BRIEF DESCRIPTION OF THE DRAWINGS

The present invention will be better understood after reading the description that follows and that is based on the drawings, in which.

DESCRIPTION OF THE PREFERRED EMBODIMENTS

Figure 1:
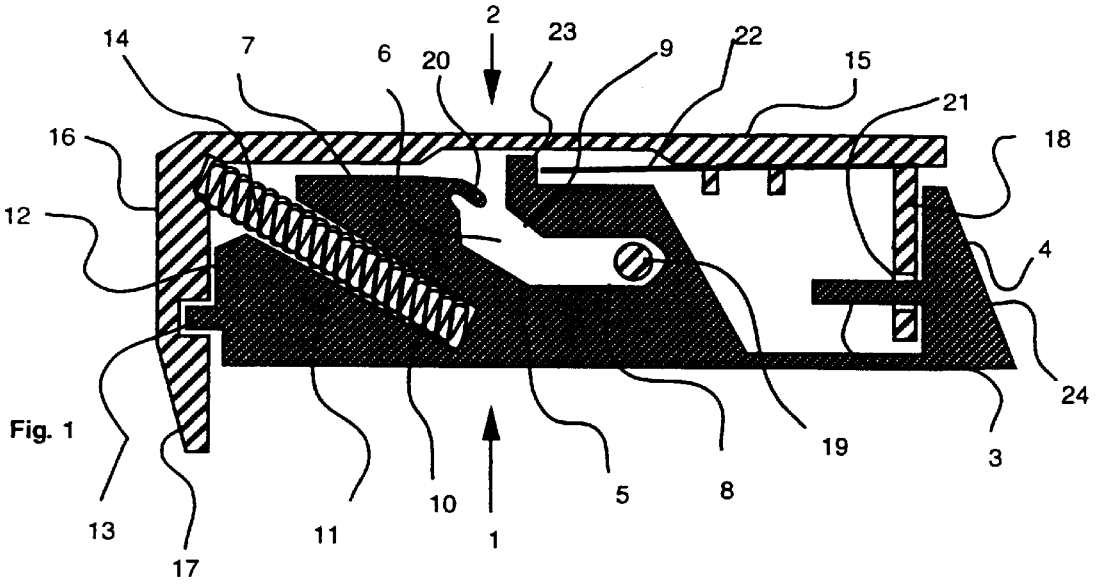
FIG. 1 represents a longitudinal cross-sectional view of the locking system in the closed position.

The locking system comprises a fixed part (1), integrally connected to the housing, and a movable part (2). The fixed part, constituting an extension of the housing, is obtained by the molding of the housing, not shown in the figure. On the back of the fixed part there is a guide (3) that extends along an axis longitudinal with respect to a back protuberance (4) perpendicular to the face of the housing. The back part has a slope (24), which is inclined so that the energy of an impact at this site is dispersed in the movable part, and it is not transmitted longitudinally to its components, which could cause cracking in extreme cases.

Figure 2:
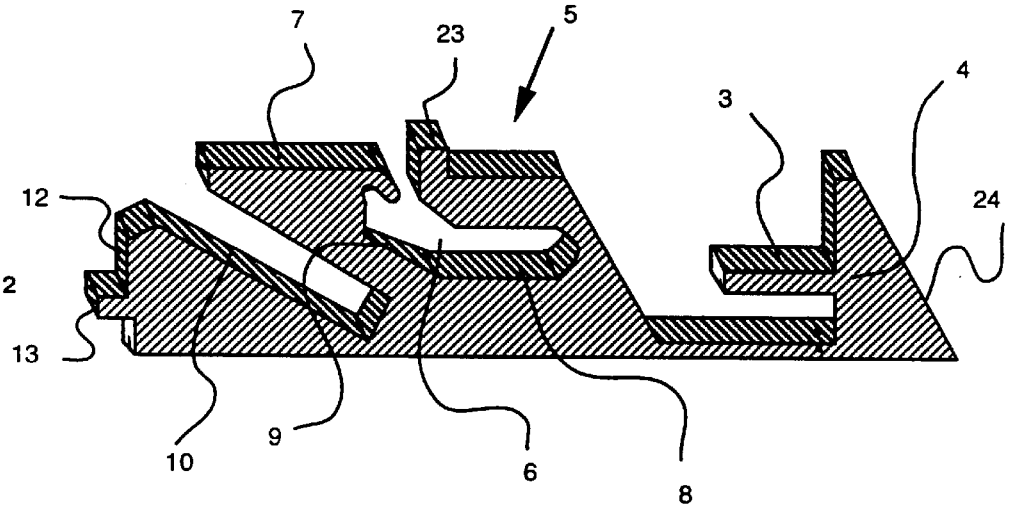
FIG. 2 represents a perspective view of the fixed part.

The fixed part (2), shown in a perspective view in FIG. 2, has another protuberance (5) located in front of the guide (3). The protuberance (5) has a hole (6) that is inclined toward the front and that opens on the top edge (7) of the protuberance (5).

The hole (6) is bent and it has a back segment (8) that is substantially longitudinal and extended by a segment (9) in a direction having a general slant toward the front, up to the top edge (7) of the protuberance (5). An elastically deformable tip (20) partially closes the inlet of the hole (6). It allows the passage by force-fitting of the rod (19) during the assembly of the movable part, and it prevents the withdrawal after assembly.

The protuberance (5) also has a hole (10) in its front part that is sloped toward the front, and which opens at the level of the front face (12). A spring (14) is housed in this hole (10).

The protuberance (5) also has on its front face an extension (13) that extends substantially longitudinally.

The movable part (2) comprises a piece whose transverse section is in the shape of an upside-down "U." The movable part has a top face (15), substantially rectangular lateral faces, and a front face (16) that is extended by an abutment (17). In addition, it comprises a transverse partition (18) placed in proximity to the back end, along with a transverse rod (19) in a median position. The transverse partition (18) is perforated by a slot (21) having a rectangular section for the passage of the guide (3).

A blade (22) is located in proximity to the top face.

In the locked position, shown in FIG. 1, the blade rests with its back end against an abutment provided on the internal surface of the top face (15), for example, against the transverse partition (18), and, at its front part, rests against an abutment (23), which extends the top surface of the protuberance (5). The blade (22) prevents the relative displacement of the movable part (2) and the fixed part (1), whereas the longitudinal segment (8) of the hole (6) and of the guide (3) prevent the vertical displacement of the movable part (2). Thus, it is impossible to separate the abutment (17) from the opening of the housing. The extension (13) also comes to be accommodated in a complementary cavity of the front face of the movable part (2) to prevent the formation of a lever arm in the case of attempted violation of the device.

Figure 3:
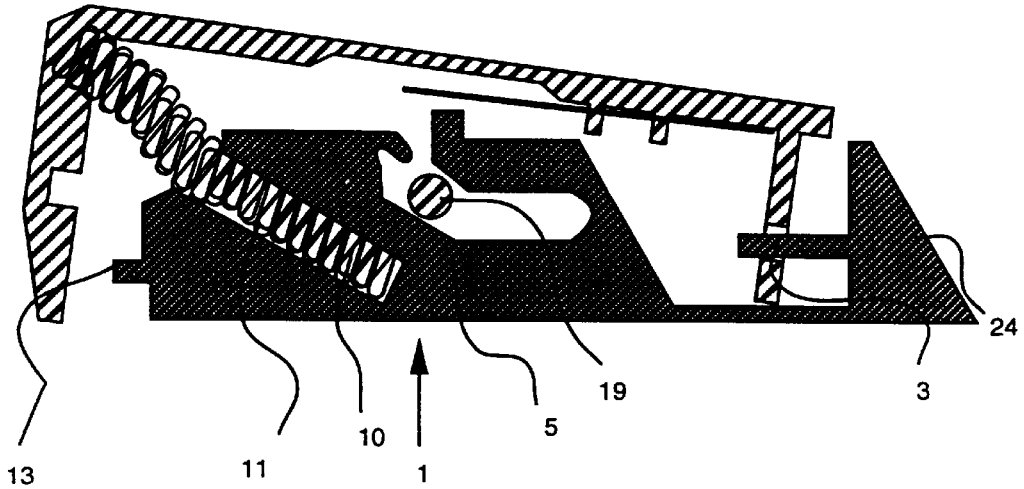
FIG. 3 represents a longitudinal cross-sectional view of the locking system in the open position.

When a magnet is brought close to the top face (15) of the movable part (2), the blade is attracted to it, and it clears the passage at the level of the abutment (23). It then becomes possible to displace the movable part (2) longitudinally to the unlocked position shown in FIG. 3. When the transverse rod (19) reaches the level of the inclined segment (9), it guides the movement of the movable part (2) in a pivoting motion with respect to the orifice (21), which ensures the displacement of the front part, notably of the abutment (17), in a direction perpendicular to the longitudinal axis. The abutment (17) then clears the slot of the housing.

To avoid an accidental unlocking, the blade has a sharpened or pointed front edge. In the case of a violent shock, it is force-fitted against the abutment (23), and the sharpened or pointed nature of the front end prevents sliding against the back surface of this abutment.

The movable part (2) can be simply clipped to the fixed part (1) at the time of assembly, which reduces the manufacturing cost. The beak (20) prevents an accidental dismantling of the system.

Naturally, the present invention can be embodied in numerous equivalent variants without leaving the scope of protection.

What is claimed is:

1. A locking system for a housing having a slot for the introduction of articles to be protected, said locking system comprising:

a fixed part, said fixed part being integrally connected to the housing and said fixed part comprising:

a guide having a section which extends in a substantially longitudinal direction; and a front protuberance having a top edge and being formed with a hole, said hole having a back segment that is substantially longitudinal and an inclined segment that extends to said top edge of said front protuberance;

a movable part, said movable part having a hollow part, said hollow part including:

a back end;

a median part;

a transverse partition being in proximity to said back end of said hollow part and formed with a slot, said slot having a section that is complementary to said section of said guide of said fixed part;

at least one transverse rod in said median part, said transverse rod working in cooperation with said hole in said front protuberance of said fixed part for guiding said movable part in a movement that is first longitudinal, then oblique; and an abutment that partially closes the slot in the housing for introducing articles therein when said locking system is in a locked position; and a locking means to prevent the displacement of said movable part without a specific tool when said locking system is in a locked position.

2. A locking system as defined in claim 1, wherein said front protuberance of said fixed part further comprises an abutment, and said locking means comprises:

a blade having first and second ends and being arranged along the top face of said movable part in a substantially longitudinal direction, where said first end of said blade is integrally connected to the back part of said movable part and said second end of said blade is free; and wherein at rest in the locked position, said second end of said blade extends against said abutment of provided on the protuberance of the fixed part.

3. A locking system as defined in claim 2, wherein said second end of said blade comprises a cutting edge.

4. A locking system as defined in claim 1, wherein said locking system further comprises a spring that bears against said fixed part and against said movable part to facilitate the displacement of the movable device after unlocking.

5. A locking system as defined in claim 4, wherein said front protuberance of said fixed part is formed with an inclined hole provided in front of said front protuberance for accommodating said spring.

6. A locking system as defined in claim 1, wherein said front protuberance of said fixed part further comprises an extension that projects out of the front face of said front protuberance; and said movable part is formed with a recess, wherein said extension and said recess work in cooperation when said locking system is in the locked position.

7. A locking system as defined in claim 1, wherein said front protuberance of said fixed part further comprises a closable beak for partially closing said hole in said front protuberance of said fixed part.

8. A locking system as defined in claim 1, wherein said fixed part further comprises a back protuberance having an inclined slope for absorbing impacts.

9. A locking system as defined in claim 1, wherein said locking system is integrally connected to a housing comprising, on its internal face, a detection label that can trigger an alarm at the time of passage in proximity to a control zone.

* * * * *